US006176615B1

(12) United States Patent
Leimkuehler

(10) Patent No.: US 6,176,615 B1
(45) Date of Patent: Jan. 23, 2001

(54) SIDE-FOLDED BAG OR SACK

(75) Inventor: Walter Leimkuehler, Hagen (DE)

(73) Assignee: Bischof und Klein GmbH & Co., Lengerich (DE)

( * ) Notice: Under 35 U.S.C. 154(b), the term of this patent shall be extended for 0 days.

(21) Appl. No.: 09/140,985

(22) Filed: Aug. 27, 1998

(30) Foreign Application Priority Data

Sep. 4, 1997 (DE) ..... 297 15 847 U

(51) Int. Cl.[7] ..... B65D 33/38
(52) U.S. Cl. ..... 383/211; 229/214; 383/906
(58) Field of Search ..... 383/210, 211, 383/906; 229/213, 214

(56) References Cited

U.S. PATENT DOCUMENTS 3,642,189 * 2/1972 Widenback ..... 229/125.42
5,392,589 * 2/1995 Buchanan ..... 229/249
5,547,284 * 8/1996 Imer ..... 383/120
5,882,117 * 3/1999 Laffon ..... 383/906

* cited by examiner

*Primary Examiner*—Stephen P. Garbe
(74) *Attorney, Agent, or Firm*—Jordan and Hamburg LLP

(57) ABSTRACT

In a side-folded bag or a sack of a flexible material, which is to be filled with a pourable material, front and rear walls of the bag are connected along an upper edge of the head end of the bag on the inside in seam fashion with one another or with the in each case adjoining half of the side fold. To form a discharging opening, a tab or handle, assigned to the inner fold edge of a side fold, is provided at the upper edge of the bag, with which handle the side fold can be pulled out between the front and rear walls of the bag and the in each case adjoining halves of the side fold, loosening the connecting seam. For closing the discharging opening once again, two triangular comer tips on either side of the inner fold edge from the front and rear walls of the bag together with the in each case adjoining halves of the side fold, are folded over along a diagonal fold line towards the outside onto the front wall or the rear wall of the bag and fixed to this detachably.

26 Claims, 9 Drawing Sheets

SIDE-FOLDED BAG OR SACK

BACKGROUND OF THE INVENTION

Figure 1:
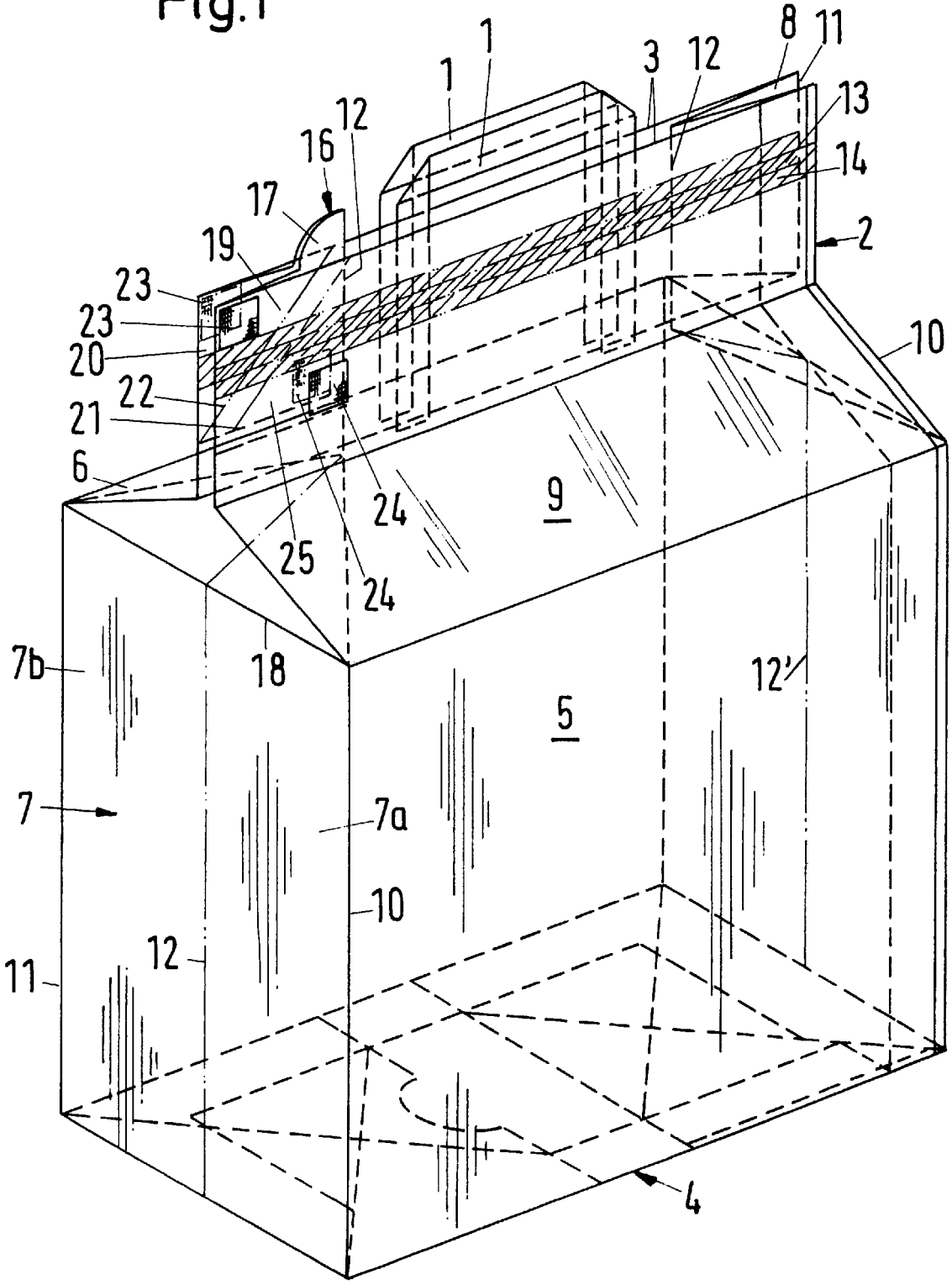

The invention relates to a side-folded bag or sack of a flexible material, which is to be filled with a pourable material.

Known side-folded bags or sacks of this type consist of paper, plastic sheets or multilayer or composite materials, which may comprise plastic films or sheets, metal foil and paper layers and, after being filled with the pourable, for example grainy, material in an optionally separate filling process, are closed off on the inside at their head end in seam fashion with one another or with the in each case adjoining half of the side fold. The formation of this connecting or closing seam at the head end takes place preferably with the help of a hot-melt or hot-scaling adhesive, which is applied with the help of the bag producer along the upper edge of the head end on the inside of the bag and activated by heat to form a sealed closing seam. However, if the inside of the bag itself has to a sufficient degree the properties of a hot-melt adhesive for forming the sealed closing seam, the application of such a hot-melt adhesive can be omitted and the sealed closing seam can be produced directly at the upper edge of the bag with the help of conventional sealing jaws.

The handle at the upper edge of the bag, which is assigned to the inner folded edge of one of the two side folds, makes it easier in the case of such bags or sacks to pull out the side fold, the connecting seam between front and rear walls of the bag and the side fold half, which in each case adjoins, being undone in order to form a discharging opening for pouring material from the bag. If, as is the case particularly with larger bags or sacks, the contents of the bag are not to be removed in a single process and, instead, only partial amounts are to be removed in several pouring processes, which are more or less spaced apart in time, it is desirable, for the protection of the material remaining in the bag, to close once again the discharging opening, formed by opening the side fold. For this purpose, it is generally not sufficient to push the side fold back into the position, which it had assumed originally in the closed head end of the bag, since the elasticity of the usual bag material permits the side fold to spring open once again more or less and thus create an opening to the interior of the bag, which prevents effective protection of the contents of the bag.

SUMMARY OF THE INVENTION

It is therefore an object of the invention to provide a side-folded bag or sack of the type indicated above, which permits the discharging opening to be closed once again reliably with simple means after material has been removed from the bag.

Due to the two triangular corner tips, which are formed pursuant to the invention on either side of the inner folding edge of the side fold used to form the discharging opening from the front and rear walls of the bag together with the in each case adjoining half of the side fold, a simple closing once again of the discharging opening is possible owing to the fact that the two corner tips, after the side fold, which has previously been pulled open, is pushed back into its original position, are folded over along their diagonal folding lines towards the outside onto the front and rear wall of the bag and detachably fixed to these. The detachable fixing can be accomplished in a simple manner with the help of suitable adhesive means, for example, in the form of applications of a permanent or pressure sensitive adhesive or sections of a tape made of hooks and loops such as that sold under the trademark VELCRO, which preferably are disposed in an appropriate format at specified points on the front and rear walls of the bag on either side of the diagonal fold line of the corner tips, for example, in the region of the triangular points of the corner tips and the congruent triangles of the front and rear walls of the bags, folded over and covered by these triangular points. By folding over the corner tips onto the front and rear walls of the bag, the adhesive means can be caused to coincide without additional measures and thus attain by simple finger pressure a mutual bonding engagement, which prevents an unintentional rupturing of the side fold. On the other hand, such an adhesive engagement can easily be undone simply by pulling on the corner tips, when an opening for pouring out the contents is to be formed once again.

The invention is described in greater detail in the following by means of the drawing in which two embodiments of the object of the invention are illustrated diagrammatically.

IN THE DRAWINGS

Figure 2:
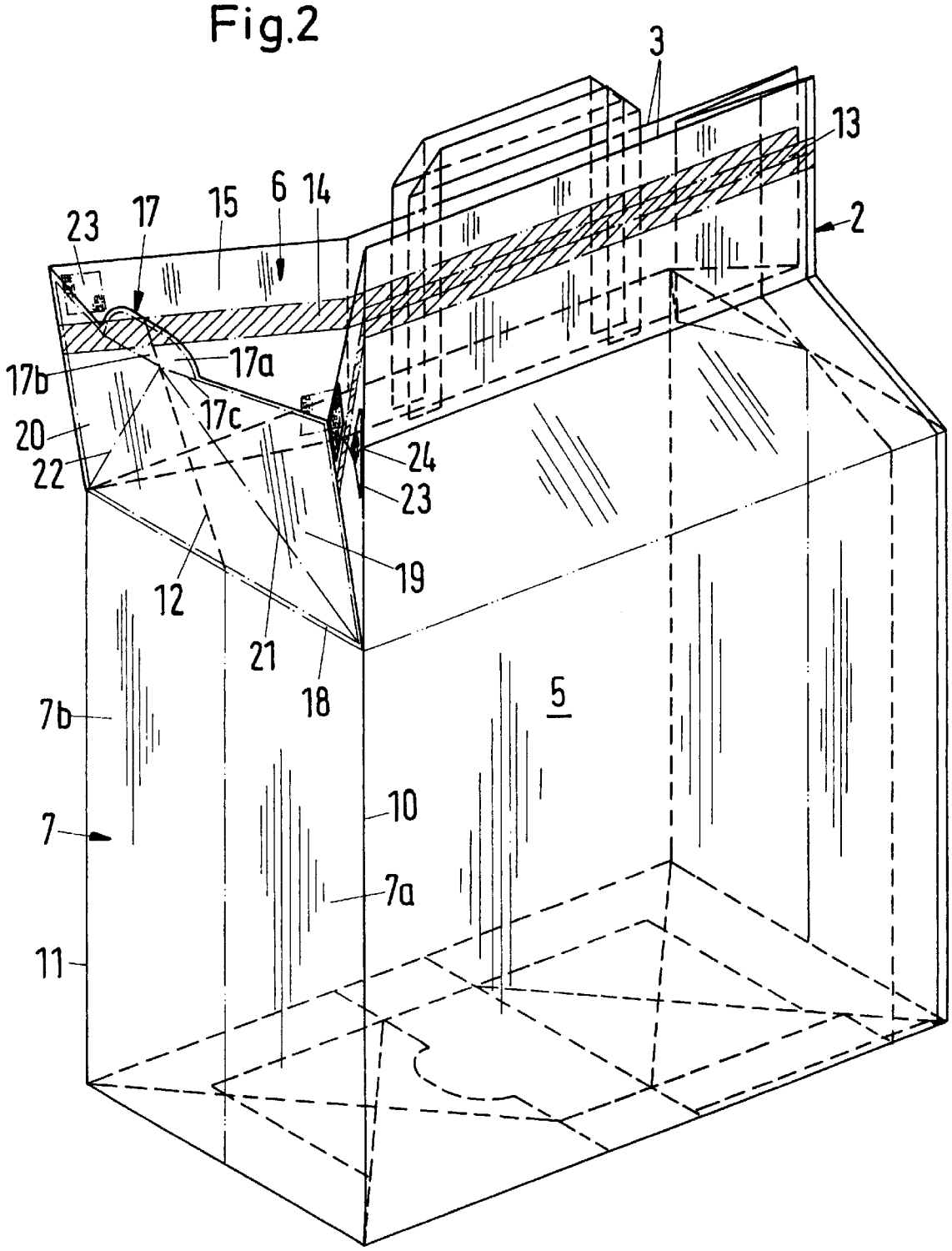
Figure 3:
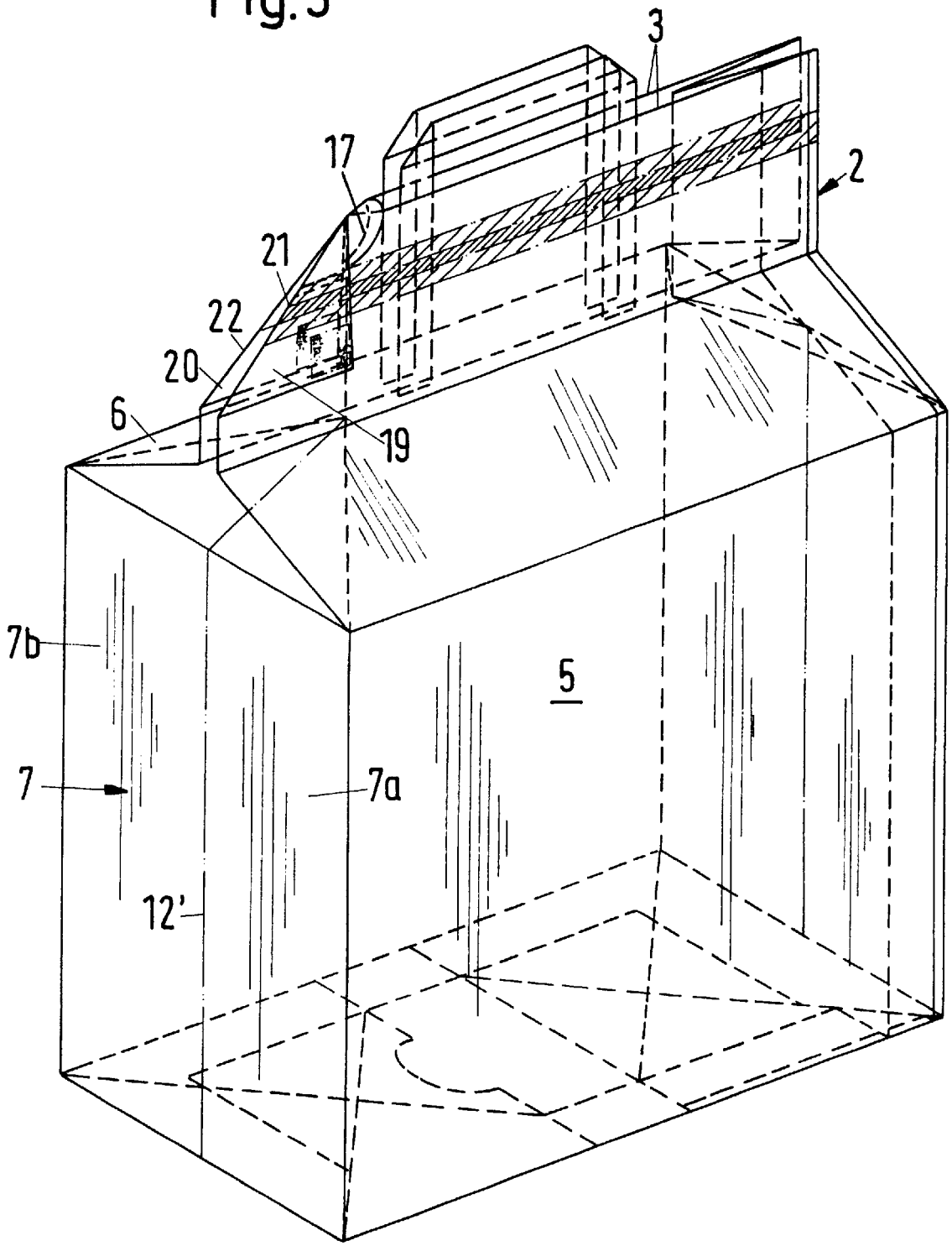
Figure 4:
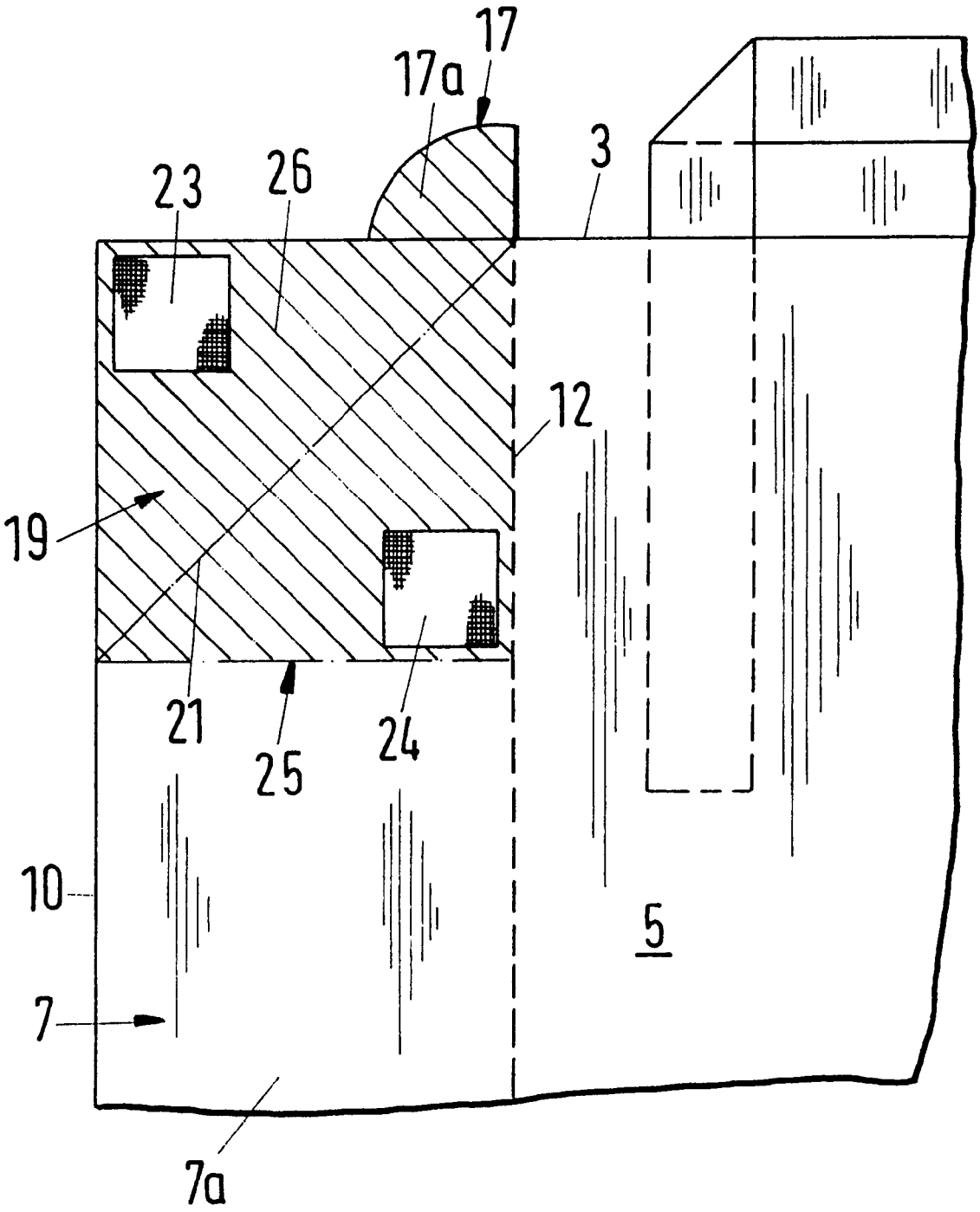
Figure 5:
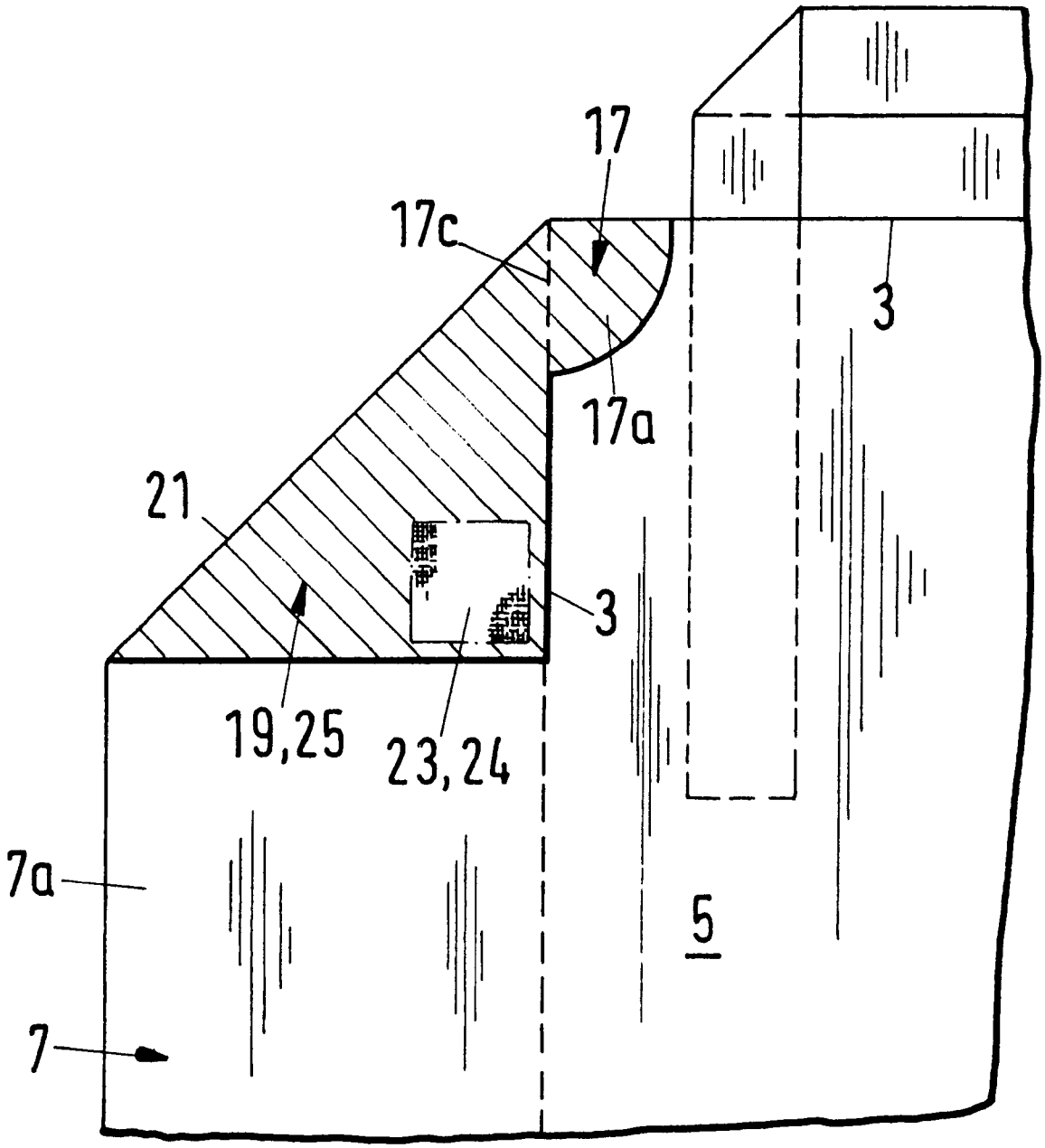
Figure 6:
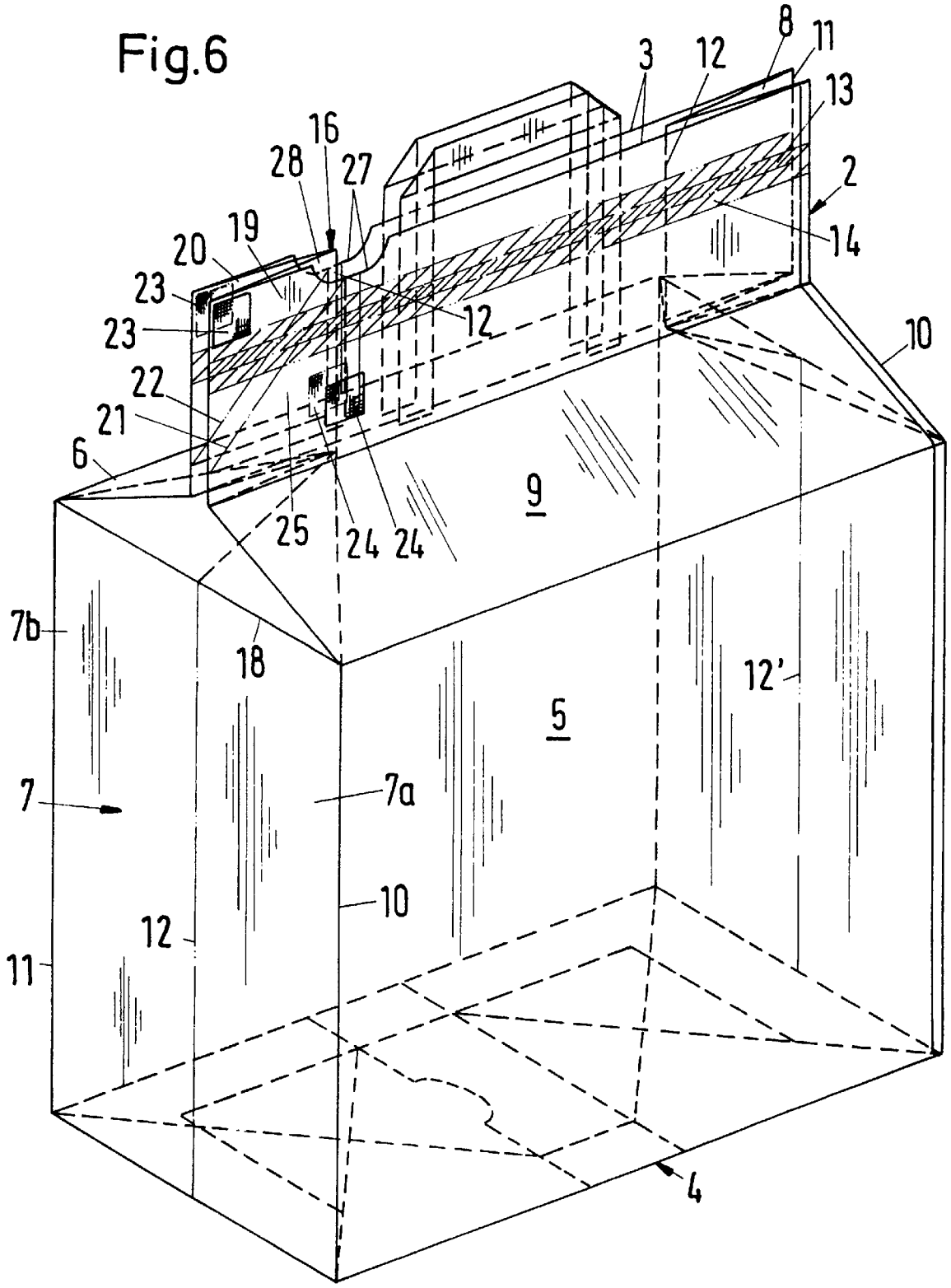
Figure 7:
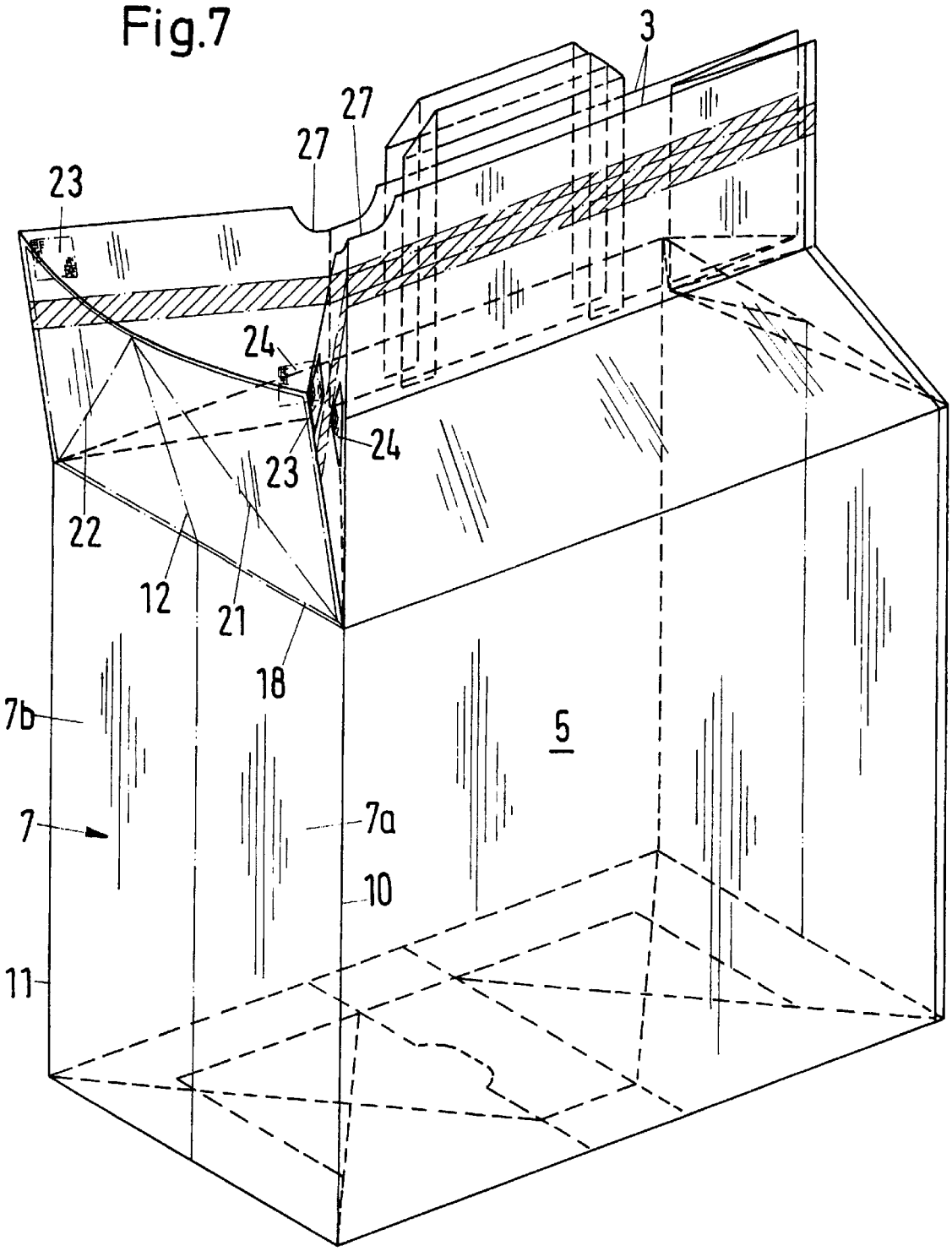
Figure 8:
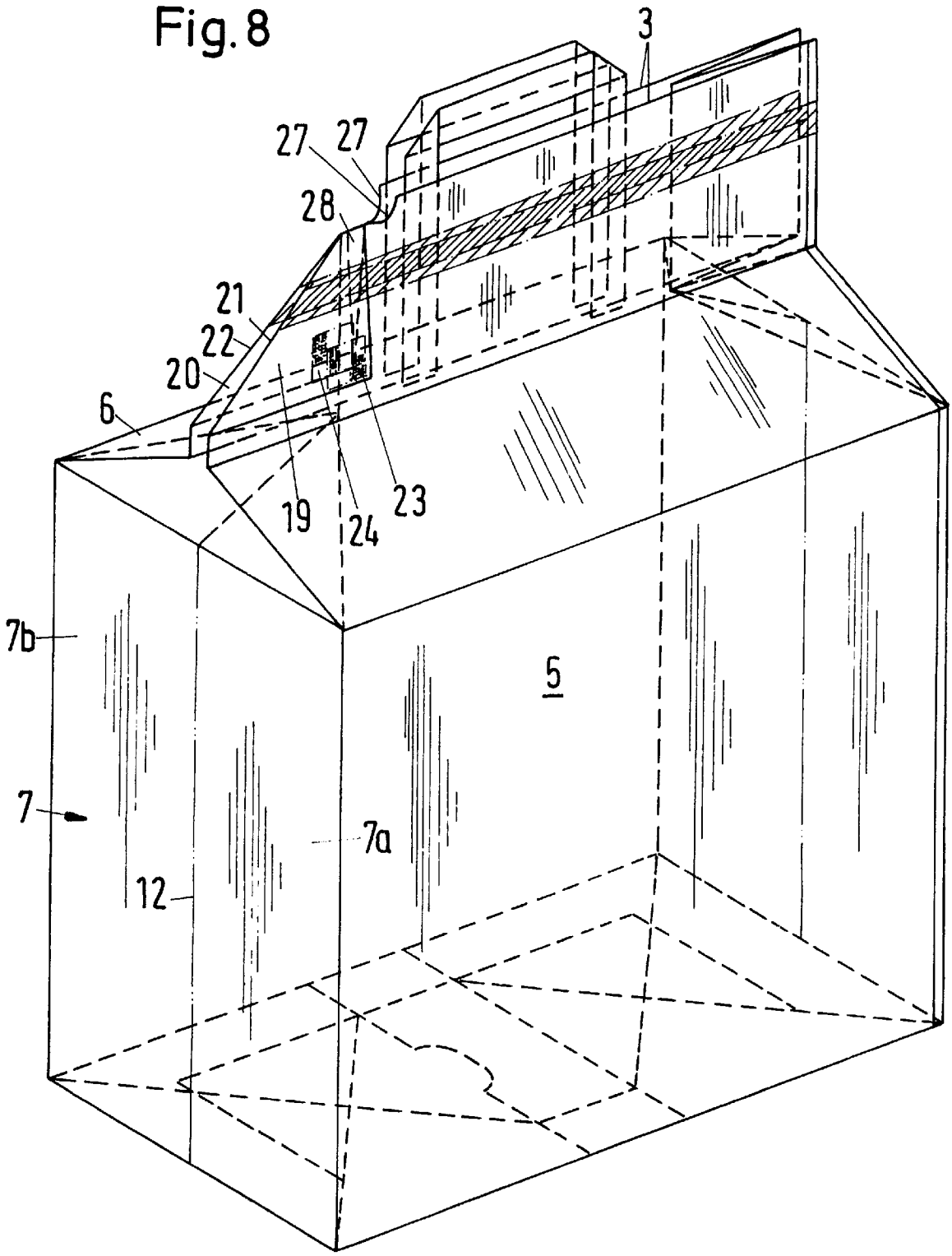
Figure 9:
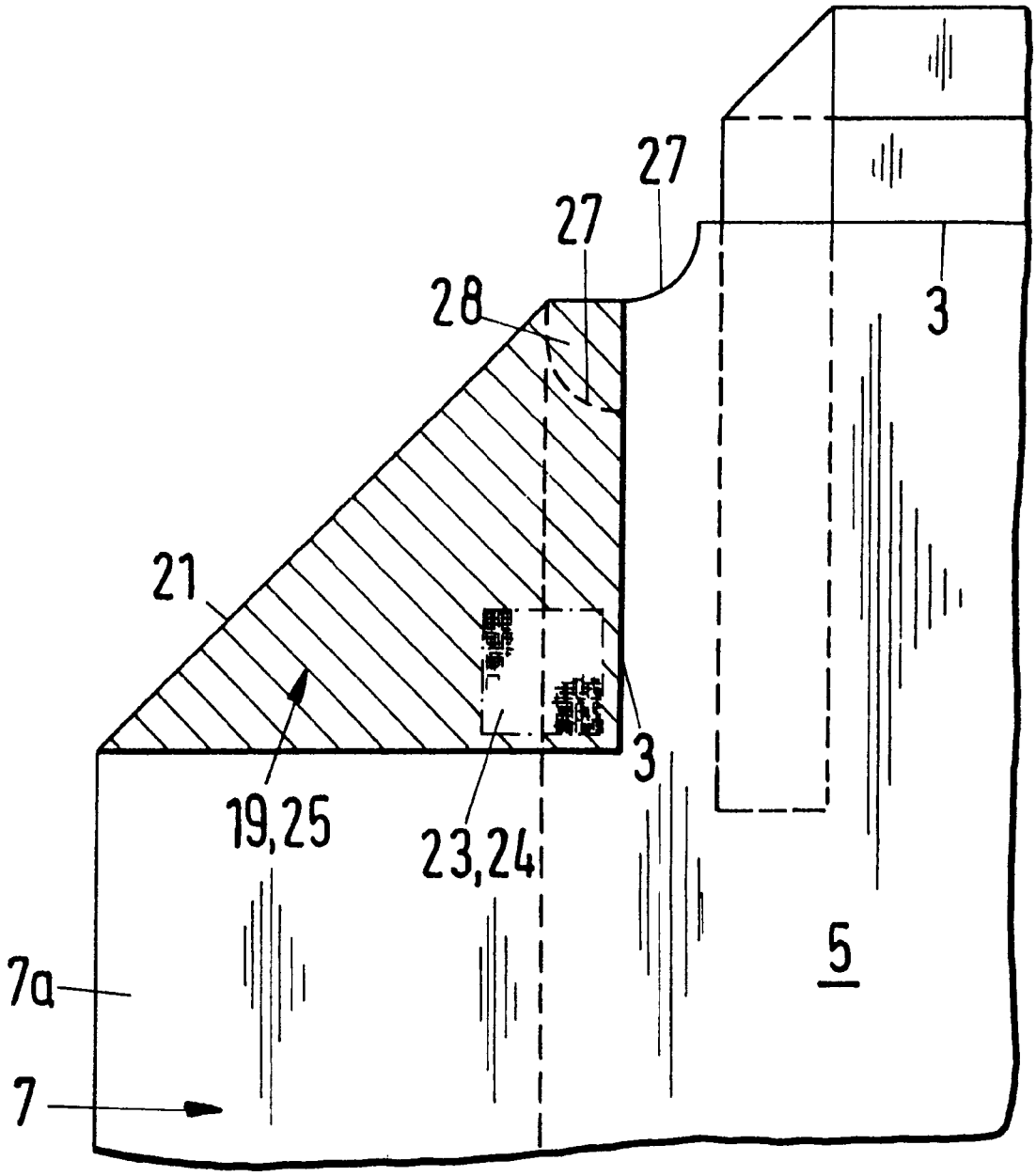

FIGS. 1 to 3 show a side-folded bag of a first embodiment of the invention in the filled state; the embodiment illustrates different use states of the head end of the filled bag, in each case in a perspective representation, FIGS. 4 to 5 show enlarged front views of a detail of the inventive bag in the representation of FIGS. 1 or 3, FIGS. 6 to 8 show representations corresponding to those of FIGS. 1 to 3 to illustrate a further embodiment of the invention, and FIG. 9 shows a front view of a detail of FIG. 8 on an enlarged scale.

DESCRIPTION OF THE PREFERRED EMBODIMENTS

The side-folded bag, shown in the drawing, consists, for example, of paper in, for example, a 2-layer construction. Between the two layers of paper, mutually opposite, U-shaped carrying loops 1, which in turn may consist of optionally fabric-reinforced paper, are glued in at the head end 2 of the bag with an overlap, corresponding to the anticipated weight to be carried, at the upper edge 3 of the head end 2. The bottom end 4 of the bag is closed off by a block bottom, in place of which there may also, in principle, be other bottom closures, such as a reel bottom. The bag furthermore comprises a front wall 5 and a rear wall 6, as well as side folds 7 and 8, which extend between the front and rear walls 5, 6 and form the side walls and which, in the filled state of the bag shown in FIGS. 1 to 3 and 6 to 8, are splayed flat in the region where the bag is filled. In the region of the head end 2, in which the walls 5 and 6 of the bag are placed flat against one another over a bilateral transition region 9, the side folds 7, 8, however, are inserted flat between the walls 5 and 6 of the bag in a manner that would correspond to the empty state of the bag. The two outer folded edges of the side folds 7, 8 are labeled 10 and 11, while the inner fold edge is labeled 12. The latter is continued over the transition region 9 in the flat-spread part of the side fold 7 and 8 as is illustrated in FIGS. 1 to 3 and 6 to 8 by lines of dots and dashes.

In FIG. 1, the bag is shown in the a first closed for carrying or storing the contents before a first removal of any contents. The head end 2 is closed here along the upper edge 3 on the inside by a hot-melt adhesive or a welded seam 13, which is formed by heating a hot-melt adhesive 14, applied in a limited region of the width. The hot-melt adhesive 14 applied and, with it, the hot-melt seam 13 extend over the whole width of the bag and create a joint between the inner sides of the walls 5 and 6 of the bag with one another and with the in each case adjoining halves 7*a*, 7*b* of the side fold.

FIG. 2 shows the bag in its open state wherin the bag is formed with a discharging opening 15. The side fold 7 is provided with a handle 16 at the upper edge 3 of the bag for pulling out the side fold 7 to form the discharge opening 15 and, at the same time, undoing the connecting seam 13 between the walls 5 and 6 of the bag and the adjoining halves 7*a*, 7*b* of the side folds. In the case of the embodiment of FIGS. 1 to 5, the handle 16 has the shape of a projection 17 beyond the upper edge 3 of the bag. The projection 17 is limited in the form of a flap on either side of the inner fold edge 12 to a region of the side fold 7, adjoining the inner fold edge 12 and, when in use, the halves are placed flat next to one another as shown in FIG. 1.

The discharging opening 15 is formed by pulling out the side fold 7 utilizing the handle 16. At the same time, the side fold 7, in the filling space region of the bag, as well as in the region of the head end 2 and the transition region 9, is spread apart and flattened while the upper portion of the inner folding edge 12 The two mirror symmetrical halves 17*a* and 17*b* of the projection 17 are also stretched flat on either side of the inner fold line 12. The upper portion of the side fold 7, stretched flat on either side of the inner fold line 12 to complete the discharging opening 15 in the form of a spout. The upper portion of the side fold 7 is bent slightly outward about a lower transverse folding line 18.

On either side of the upper portion of the inner fold 12, as shown in FIG. 2, two triangular corner tips 19 and 20 are formed each by means of a diagonal fold line 21, 22 as a means for closing the discharging opening 15 once again. The two triangular corner tips 19 and 20 extend from the foot point of the inner fold edge 12 to the point where the transverse fold line 18 connects with the outer fold edge 10 or 11 of the side fold 7 and endow the corner flaps 19, 20 with the shape of an isosceles right angle triangle in a double-layer construction, since they are formed in each case congruently by the front wall 5 of the bag with the adjoining half 7*a* of the side fold and the rear wall 6 of the bag with the adjoining half 7*b* of the side fold.

In order to close the discharging opening 15 once again to a second closed state, as shown in FIG. 3 for example, the side fold 7 is pressed back in the region above the transverse fold line 18 into the original position once again, somewhat like that of FIG. 1, and the triangular comer tips 19 and 20, held flat against one another with their two layers, are folded over along their diagonal fold lines 21 and 22 in opposite directions towards the outside onto the front wall 5 or the rear wall 6 of the bag and detachably fixed on this in such a position, that a secure closure of the discharging opening 15 is ensured. FIG. 3 shows this state of the discharging opening 15, in which it is closed once again, with corner tips 19 and 20, fixed on the outside of the walls 5 and 6 of the bag with diagonal folding lines 21, 22.

For detachably fixing the corner tips 19 and 20, sections 23 and 24 of tape made of hooks and loops such as that sold under the trademark VELCRO are mounted, for example by gluing, on the outside of the front wall 5 and the rear wall 6 of the bag in the region of the side fold 7 as shown, for example, in FIG. 1 inserted. Instead of the sections 23, 24, an adhesive, which initially is covered by a protective sheet, can also be applied appropriately. The protective sheet is then removed when the applications 23, 24 are to be brought for the first time into mutual adhesive engagement. The sections or applications 23, 24 on the outside of the walls 5, 6 of the bag are identified in the drawing by cross-hatching.

The sections or applications 23, 24 of the bonding agent are limited to the region of the triangular points of the corner tips 19, 20 and of the triangles 25 of the front wall 5 and the rear wall 6 of the bag, which are congruent with the comer tips 19, 20. The triangles 25 are covered by the comer tips 19, 20 when they are folded about their diagonal fold line 21, 22 onto the outside of the walls 5, 6 of the bag. The sections or applications 23, 24 of the bonding agent mutually cover one another hereby, as a result of which the adhesive bonding between the comer tips 19, 20 and the walls 5, 6 of the bag is brought about. This can be seen particularly clearly in the enlarged, detailed representations of FIGS. 4 and 5.

Furthermore, in FIGS. 4 and 5, a blank 26 of a reinforcing material, which is connected in the region of the side fold 7 between the upper edge 3 of the bag and the transverse fold line 18 with the inside of the bag material, for example, by gluing, is furthermore indicated by inclined hatching. The reinforcing material of the blank 26 comprises, in particular, a metal foil, preferably an aluminum foil, which imparts increased stiffness to the part of the side fold 7, used to form the discharging opening 15 and, with that, good moldability for forming the discharging opening 15 by hand into a spout.

On the inside, facing the interior of the bag, the blank 25 carries a layer of hot-melt adhesive, with which a hot-melt adhesive bond, which can easily be peeled apart, can be produced between the side fold halves 7*a*, 7*b*, covered on the inside by the blank 25 and the inside of the adjoining walls 5 and 6 of the bag in the course of the application of the hot-melt adhesive seam 13. The formation of a hot-melt adhesive layer in such a manner, that the hot-melt sealing seam, formed by heating this layer, can easily be peeled apart, can be attained in a known manner by appropriately adjusting the thermoplastic synthetic resin, such as polyethylene or polypropylene, used for the hot-melt adhesive layer. Accordingly, when the side fold 7 is opened for the first time to form the discharging opening 15, the hot-melt connection between the halves 7*a*, 7*b* of the side fold and the walls 5 and 6 of the bag can easily be undone without having to use a force, which could lead to a destruction of the head end 2 of the bag or impair the welded sealing seam 13 in the remaining region of the bag.

The projection 17, used as handle 16, is formed as a one-piece extension of the bag and, in the case of the preferred use of the reinforcing blank 25, is thus formed from a material composite, which is composed of the actual bag material, such as paper, and the reinforcing material 25. This is shown clearly in FIGS. 4 and 5 by the hatching, which includes the projection 17.

As can be inferred from FIG. 3 and particularly also from FIG. 5, the projection 17 for closing the discharging opening 15 once again to the second closed position can be folded over towards the interior of the bag. If now the comer tips 19, 20 in turn are folded about its baseline 17*c* FIG. 5 about their diagonal fold lines 21, 22 and, with the help of the bonding agent sections or applications 23, 24, fixed to the outside of the walls 5 and 6 of the bag, then the projection 17 in turn can be opened folded down on the upper edge 3 of the bag, overlapping this astride and, at the same time, exerting a tension, acting in the closing sense, as a holding down force on the upper edge 3 of the bag. Of course, the projection 17 can also be folded back simply by hand, if a discharging opening 15 is to be formed once again.

FIGS. 6 to 9 illustrate an embodiment of the invention, for which the handle 16 is formed by a cutout 27 in the front wall 5 and the rear wall 6 of the bag in the upper edge 3 of the head 2 of the bag. These cutouts 27 expose the upper inner corner region 28 of the side fold 7 on either side of its inner fold edge 12 for seizing by hand. The two cut-outs 27 have a flat grooved profile with rounded ends and essentially flat cut-out edges in the central profile region on either side of the inner fold edge 12 of the side fold 7.

In other respects, this embodiment of the invention agrees with the example described previously, as is made clear by using the same reference numbers to denote similar or identical parts. The manipulations for producing and closing the discharging opening 15 are also basically the same for the two embodiments.

This is also the case for folding over the handle 16 onto the upper edge 3 of the bag for closing the previously produced discharging opening 15 once again, insofar as the upper inner corner region 28, similarly to the projection 17, can be folded about its baseline towards the interior of the bag, so that, when the corner tips 19, 20 are folded over and fixed on the outside of the walls 5, 6 of the bag once again, in the present case the flat cut-out edges of the cut-outs 27 can be folded onto the upper edge 3 of the bag, overlapping this edge 3 astride, in order to exert a holding-down force on the upper edge 3 of the bag.

For opening the discharging opening once again, the corner region 28 can readily be folded back here also, in order to serve as handle for pulling out the side fold 7 to form the discharging opening 15, as described.

What is claimed is:

1. A side folded container for containing a pourable material comprising front and rear walls along with side walls, a bottom wall and a head end, said container having first and second closed states and an open state, a closure seam closing off said head end when said container is in said first closed state, a pouring spout formed on said head end when said container is in said open state, said pouring spout when said container is in said open state being formed between spaced apart head end portions of said front and rear walls and by a head end section of one of said side walls, said head end section of said one side wall having a region which is folded over on itself and sandwiched between said head end portions of said front and rear walls when said container is in said first closed state, said closure seam closing off said region of said head end section of said one side wall and said head end portions of said front and rear walls when said container is in said first closed state, said head end section of said one side wall having a tab adapted to be grasped when said container is in said first closed state to facilitate changing the container from its first closed state to its open state, said head end portion of said front wall having a first sub-portion and a second sub-portion, said first sub-portion being folded relative to said second sub-portion to provide a superimposed relationship between said first and second sub-portions when said container is in said second closed state, said head end portion of said rear wall having a third sub-portion and a fourth sub-portion, said third sub-portion being folded relative to said fourth sub-portion to provide a superimposed relationship between said third and fourth sub-portions when said container is in said second closed state, said first and second superimposed sub-portions being superimposed with said third and fourth superimposed sub-portions when said container is in said second closed state and retaining devices between said first and second sub-portions and between said third and fourth sub-portions for retaining the respective sub-portions in said superimposed relationship when said container is in said second closed state.

2. A side-folded container according to claim 1 wherein said retaining devices are applied to said second and fourth sub-portions.

3. A side-folded container according to claim 1 wherein said retaining devices include a tape made of hooks and loops.

4. A side-folded container according to claim 1 wherein said retaining devices include pressure sensitive adhesive.

5. A side-folded container according to claim 1 wherein first and second sub-portions are substantially coplanar when said container is in said first closed state, said third and fourth sub-portions being substantially coplanar when said container is in said first closed state.

6. A side-folded container according to claim 1 wherein said first sub-portion is generally configured as a first triangle having a first base side, said second sub-portion being generally configured as a second triangle having a second base side common with said first base side, said first sub-portion being folded over onto said second sub-portion along said common base line when said container is in said second closed state.

7. A side-folded container according to claim 6 wherein said third sub-portion is generally configured as a third triangle having a third base side, said fourth sub-portion being generally configured as a fourth triangle having a fourth base side common with said third base side, said third sub-portion being folded over onto said forth sub-portion along the last said common base line when said container is in said second closed state.

8. A side-folded container according to claim 1 wherein said tab is in a superimposed relationship with said front and rear walls when said container is in said second closed state.

9. A side-folded container according to claim 1 wherein said tab is in a non-superimposed relationship with said front and rear walls when said container is in said first closed state.

10. A side-folded container according to claim 1 wherein said tab includes two tab parts joined to one another at a first fold line, said region of said head end section of said one side wall having two sub-regions joined to one another at a second fold line generally perpendicular to said first fold line.

11. A side-folded container according to claim 1 wherein said region has a first segment and a second segment, said first segment having a first and a second sub-segment, said first sub-segment being foldable relative to said second sub-segment in a superimposed relationship to provide first and second superimposed sub-segments when said container is in said second closed state, said second segment having a third and a fourth sub-segment, said third subsegment being foldable relative to said fourth sub-segment in a superimposed relationship to provide third and fourth sub-segments when said container is in said second closed state.

12. A side-folded container according to claim 11 wherein said first and second superimposed sub-segments are disposed in superimposed relationship with said third and fourth superimposed sub-segments to provide superimposed first to fourth sub-segments when said container is in said second closed state.

13. A side-folded container according to claim 12 wherein said first and second superimposed sub-portions are disposed in superimposed relationship with said third and fourth superimposed sub-portions to provide superimposed first to fourth sub-portions when said container is in said second closed state, said superimposed first to fourth sub-segments being disposed in superimposed relationship with said superimposed first to fourth sub-portions of said head end portions of said front and rear walls when said container is in said second closed state.

14. A side-folded container according to claim 4 wherein said first and second sub-segments are substantially coplanar when said container is in said first closed state, said third and fourth sub-segments being substantially coplanar when said container is in said first closed state.

15. A side-folded container according to claim 1 further comprising a reinforcing material joined to said head end section of said one side wall.

16. A side-folded container according to claim 1 wherein said region of said head end section of said one side wall has a first sub-region and a second subregion, a fold line between said first and second sub-regions, said first and second subregions being folded about said fold line to dispose said first and second sub-regions in a superimposed relationship when said container is in said first closed state, said first and second sub-regions being disposed substantially coplanar when said container is in said open state.

17. A side-folded container according to claim 16 further comprising a first adhesive adhering said first sub-region to said head end portion of said front wall when said container is in said first closed state and a second adhesive adhering said second sub-region to said head end portion of said rear wall when said container is in said first closed state.

18. A side-folded container according to claim 1 wherein said tab has a first tab area and a second tab area, said tab having a fold line between said first and second tab areas, said first and second tab areas being folded about said fold line to dispose said first and second tab areas in superimposed relationship when said container is in said first closed state.

19. A side-folded container according to claim 18 wherein said fold line between said first and second tab areas is a first fold line, said region of said head end section of said one side wall having a first sub-region and a second sub-region, a second fold line between said first and second sub-regions, said first and second sub-regions being folded about said second fold line to dispose said first and second sub-regions in a superimposed relationship when said container is in said first closed state, said first and second fold lines being substantially linearly co-extensive when said container is in said first closed state.

20. A side folded container for containing a pourable material comprising front and rear walls along with side walls, a bottom wall and a head end, said container having first and second closed states and an open state, a closure seam closing off said head end when said container is in said first closed state, a pouring spout formed on said head end when said container is in said open state, said pouring spout when said container is in said open state being formed between spaced apart head end portions of said front and rear walls and by a head end section of one of said side walls, said head end section of said one side wall having a region which is folded over on itself and sandwiched between said head end portions of said front and rear walls when said container is in said first closed state, said closure seam closing off said region of said head end section of said one side wall and said head end portions of said front and rear walls when said container is in said first closed state, said head end section of said one side wall having a tab adapted to be grasped when said container is in said first closed state to facilitate changing the container from its first closed state to its open state, said region of said head end section of said one side wall having a common fold line with said tab, said tab extending above said fold line when said container is in said first closed state, said tab extending below said fold line when said container is in said second closed state, said head end portion of said front wall having a first sub-portion and a second sub-portion, said first sub-portion being folded relative to said second sub-portion to provide a superimposed relationship between said first and second sub-portions when said container is in said second closed state, said head end portion of said rear wall having a third sub-portion and a fourth sub-portion, said third sub-portion being folded relative to said fourth sub-portion to provide a superimposed relationship between said third and fourth sub-portions when said container is in said second closed state, said first and second superimposed subportions being superimposed with said third and fourth superimposed sub-portions when said container is in said second closed state.

21. A side-folded container according to claim 20 wherein said region of said head end section of said one side wall has an upper edge, said upper edge being substantially linearly co-extensive with said fold line when said container is in said open state.

22. A side folded container for containing a pourable material comprising front and rear walls along with side walls, a bottom wall and a head end, said container having first and second closed states and an open state, a closure seam closing off said head end when said container is in said first closed state, a pouring spout formed on said head end when said container is in said open state, said pouring spout when said container is in said open state being formed between spaced apart head end portions of said front and rear walls and by a head end section of one of said side walls, said head end section of said one side wall having a region which is folded over on itself and sandwiched between said head end portions of said front and rear walls when said container is in said first closed state, said closure seam closing off said region of said head end section of said one side wall and said head end portions of said front and rear walls when said container is in said first closed state, said head end section of said one side wall having a tab adapted to be grasped when said container is in said first closed state to facilitate changing the container from its first closed state to its open state, said head end portions of said front and rear walls having an upper edge, a recess extending downwardly from said upper edge when said container is in said first closed state, said tab being disposed in said recess when said container is in said first closed state, said head end portion of said front wall having a first subportion and a second sub-portion, said first sub-portion being folded relative to said second sub-portion to provide a superimposed relationship between said first and second sub-portions when said container is in said second closed state, said head end portion of said rear wall having a third sub-portion and a fourth sub-portion, said third sub-portion being folded relative to said fourth sub-portion to provide a superimposed relationship between said third and fourth sub-portions when said container is in said second closed state, said first and second superimposed sub-portions being superimposed with said third and fourth superimposed sub-portions when said container is in said second closed state.

23. A side-folded container according to claim 22 wherein said region of said head end section of said one side wall has a corner area which forms said tab when said container is in said first closed state.

24. A side-folded container according to claim 22 wherein sections of said upper edge of said head end portion of said front and rear walls define an upper terminating edge of said head end portions of said front and rear walls when said container is in said first closed state, said recess having an area extending downwardly from said upper terminating edge into said head end portions of said front and rear walls when said container is in said first closed state.

25. A side-folded container according to claim 22 wherein said region of said head end section of said one side wall has a fold line having a first section disposed between said head end portions of said front and rear walls when said container is in said first closed state, said fold line having a second section extending into said recess when said container is in said first closed state, said recess having recess areas on opposite sides of said upper section of said fold line when said container is in said first closed state.

26. A side-folded container according to claim 22 wherein said recess has a recess edge having a first edge part and a second edge part, said first edge part being disposed in a superimposed relationship with said second edge when said container is in said second closed state.

* * * * *